US005620034A

United States Patent [19]

Flis

[11] Patent Number: 5,620,034

[45] Date of Patent: Apr. 15, 1997

[54] FOLDABLE COVERING DEVICES FOR GOLF BAGS

[76] Inventor: Albert J. Flis, 11427 Blodgette Creek Trail, Strongsville, Ohio 44136

[21] Appl. No.: 360,385

[22] Filed: Dec. 21, 1994

[51] Int. Cl.[6] ..... A63B 57/00

[52] U.S. Cl. ..... 150/159; 206/315.4

[58] Field of Search ..... 150/159, 160; 135/16, 25.41, 25.1; 206/315.4

[56] References Cited

U.S. PATENT DOCUMENTS

| | | | |
|---|---|---|---|
| 238,365 | 3/1881 | Dennis | 135/25.1 X |
| 892,813 | 7/1908 | Dolles | 135/25.41 X |
| 2,172,549 | 9/1939 | Solomon | 135/25.41 |
| 2,282,695 | 5/1942 | Badovinac | 135/25.41 X |
| 3,825,024 | 7/1974 | Cohen | 135/25.1 |
| 4,084,600 | 4/1978 | De Polo | 135/25.41 X |
| 4,455,030 | 6/1984 | Rosen | 135/16 X |
| 4,512,465 | 4/1985 | Jobe | 206/315.4 |
| 4,522,300 | 6/1985 | Hamblet | 206/315.4 |
| 4,624,275 | 11/1986 | Baldwin | 135/25.41 X |
| 4,699,164 | 10/1987 | Picney et al. | 135/16 |
| 4,788,996 | 12/1988 | Forshef | 206/315.4 X |
| 4,821,756 | 4/1989 | England | 135/25.41 X |
| 5,277,211 | 1/1994 | Hendershot | 135/16 |
| 5,280,798 | 1/1994 | Helm | 150/159 X |

FOREIGN PATENT DOCUMENTS

| | | | |
|---|---|---|---|
| 6304011 | 11/1994 | Japan | 135/16 |
| 1558960 | 1/1980 | United Kingdom | 135/16 |
| 2254007 | 9/1992 | United Kingdom | 150/159 |

*Primary Examiner*—Sue A. Weaver

*Attorney, Agent, or Firm*—Fay, Sharpe, Beall, Fagan, Minnich & McKee

[57] ABSTRACT

A foldable covering device for a golf bag includes an elongated housing member or tube adapted to fit within the parameters of a golf bag along with several golf clubs. The housing tube has a smooth inner surface adapted to slidably receive an elongated rigid support member or rod. The rigid support rod has an upper end to which is attached a flexible water impervious cover material or sheath having an opened end and loose side walls. The flexible cover is adapted to fit over the open end of a golf bag to prevent water in the form of rain, sleet, etc. from entering therein.

14 Claims, 3 Drawing Sheets

FOLDABLE COVERING DEVICES FOR GOLF BAGS

BACKGROUND OF THE INVENTION

The present invention relates generally to the art of foldable or wrapable covering devices for the open, club-head end of golf bags. The invention finds particular usefulness in application with golf bags or other apparatuses for holding golf clubs during play in inclement weather.

Standard golf club bags are generally cylindrical in shape with an open upper end and a substantially closed bottom or lower end. Golf clubs are arranged within the bag with the clubs inverted so that their heads extend out of the open end of the bag and the shafts and grips are protected in the interior of the bag. Typically, these bags have carrying slings or straps and other storage components for golf balls, etc. Such bags are commonly moved upon wheeled carriers, golf carts, or can be carried manually. However carried, the open, club-head ends of the golf club bags are exposed to elements of the weather, including rain.

In this regard, due to the fact that the heads of the golf clubs extend axially outward and upward of the golf bag opening, it is difficult to cover the opening of the bag when it rains. In the event of a sudden rain storm, a cloth-like hood or an umbrella may be placed over the golf club bag, and the covered bag may be carried to shelter.

However, in the event of drizzle or light rain, during which golf play may continue, a cloth cover or an umbrella is generally not feasible for preventing water from entering the golf bag opening. This is because during play, the golfer must have repetitive access to the bag to remove and replace golf clubs. Consequently, leaving the bag open for any substantial length of time permits water to enter the upper opened end of the bag.

Furthermore, not only will the exposed heads of the golf clubs become wet due to the need of repetitive access to the clubs during play, with time the precipitation will also descend vertically down the shafts thereby wetting the grip ends of the clubs. This is unsatisfactory since dry grip ends may be critical in perfecting one's golf swing.

As a result, there has been a need for some relatively inexpensive and effective means for covering or enclosing the open top of the bag and the golf club heads during inclement weather, but which cover can be rapidly or momentarily removed and replaced so that the golfer can have quick and easy access to the clubs during play.

Along these lines, many golfers utilize a full-size umbrella while golfing in the rain. However, umbrellas ordinarily cannot be positioned closely and efficiently above the open end of the golf bag to provide access to the clubs and to simultaneously protect the heads of the clubs and the bag. Furthermore, usually such umbrellas are used to protect the individual golfer rather than the bag. In addition, many of these umbrellas take up substantial space in the golf bag. Thus, ordinary umbrellas fail to provide a suitable alternative to covering or enclosing the golf bags when rain occurs during a golf game.

Heretofore, the aforementioned problems have been addressed using a collapsible umbrella for a golf bag. In such embodiments, the umbrella is carried within the bag, along with the clubs, for immediate use when needed. The umbrella may be collapsed and reopened for access to the clubs.

Several of these collapsible umbrellas are described in prior issued U.S. Pat. Nos. 4,522,300, 4,788,996, 4,832,362, 4,852,896, and 5,277,211. Of these patents, U.S. Pat. Nos. 4,522,300 and 4,788,996 issued to Hamblet and Forshee respectively are the most pertinent. These collapsible umbrellas comprise a series of intricately connected parts including a cloth-like portion and a series of curved, resiliently flexible ribs interconnected thereto. When not in use, the collapsible umbrella is housed in a tube. When the collapsible umbrella is opened, the curved, resiliently flexible ribs snap out into a radially outward and downward position. The cloth-like portion of the collapsible umbrella is stretch taught over the extended ribs and forms a protective rigid dome above the open golf bag.

The Hamblet and Forshee golf umbrellas are useful in protecting the open end of a golf bag. However, these prior issued patents exhibit several drawbacks solved by the present invention.

One drawback relates to the complicated and relatively expensive umbrella linkage necessary to maintain the cloth-like portion open above the golf bag. In contrast to the present invention, the cloth-like portion must be stitched or otherwise fastened to the resiliently flexible ribs so that the cloth-like portion collapses or stretches open with the ribs. Free ends of the ribs must be pivotally connected to a collar so that the ribs rotate as the cloth-like portion is opened or closed.

Another draw back relates to permanent connection between the cloth-like portion and the ribs. In use, the cloth-like structure may sustain tears, rips or other permanent damage. However, since the cloth-like structure is stitched or otherwise fixedly connected to ribs, replacement of the damaged cloth-like portion becomes difficult if not impossible, resulting in a device inoperative for its intended purposes. Moreover, the cloth-like portion may be relatively expensive itself.

Accordingly, there is a need for a relatively inexpensive, compact and user friendly device for protecting the open end of a golf bag during play in adverse weather conditions. The cover must be easily removed and replaced for use during continuous golf play.

The present invention herein provides protection for a golf bag without the need for complicated umbrella support linkage. In this regard, the present invention concerns a foldable or wrapable, waterproof, shroud-like cover or sheath for an open end of a golf bag. The foldable cover is stored in an elongated housing carried within the golf bag along with several golf clubs. Upon engagement, the foldable cover provides immediate use when needed. In addition, during disengagement, the cover may be easily and quickly rolled-up or folded.

Further, the present invention provides the useful advantage of prohibiting vertical precipitation from entering the open end of a golf bag during inclement weather without the need for expensive and complicated curved, resiliently flexible ribs of the prior issued patents.

These and other additional objects and advantages of the present invention will become apparent from the following description of the invention.

SUMMARY OF THE INVENTION

The present invention relates to a device having a flexible, foldable or wrapable protective cover member for sheltering, when unfolded or unwrapped, the open end of a golf bag and the golf clubs extending therefrom. The flexible cover member is impervious to descending precipitation or rain.

To house or store the foldable cover member, an elongated, preferably open ended tubular housing member or tube is provided. This tube is adapted to fit the golf bag along with several golf clubs. Preferably the tubular housing member is of the same size and configuration as plastic tubes used to house and separate the shafts of various golf clubs.

An elongated, rigid support member or rod is also provided. The rigid support member is coaxially contained within the tube and moveable or slidable therein. This rod has an outer diameter less than an inner diameter of the tubular housing member.

Releaseably connected to an upper end portion of the rod is a flexible, water impervious cover member or sheath for enclosing the open end of the golf bag. This flexible cover has a central closed end portion, and a peripheral open end portion with a flexible wall connected therebetween. The rigid rod can be extended from its housing tube and the flexible cover can be unfolded or unwrapped with the open end portion dropped or placed over the open end of the golf bag to protect golf clubs from adverse weather. A retaining cap releaseably secures the closed end portion of the flexible cover to the upper end portion of the rod. Optionally, a cylindrical retaining guide can also be included to inhibit radial movement of the rigid support member.

To store the flexible cover within the tube during non-use, the golfer turns the retaining cap and rod with one hand while twisting the flexible cover around the rigid rod with the other hand. In this manner, the flexible cover is tightly wrapped around the rod. Lastly, the rod and the flexible cover member are slidably fitted or inserted into the tube with a twisting motion until the retaining cap is substantially contained therein. In the stored state, the folded cover is positioned coaxially between the inner surface of the tube and the outer surface of the rigid rod.

An object of the present invention is to provide an inexpensive but sturdy flexible cover for the open end of a golf bag to protect golf clubs therein from harsh weather elements. The cover can be slightly raised on one end in order to allow for club removal and/or replacement during play.

Another object of the present invention is to provide for a flexible cover which may be rapidly and easily opened over the heads of the golf clubs, which cover is compact and easily stored using minimal space within the golf bag along with several golf clubs.

A further object of the present invention is to provide for a flexible golf bag cover formed from lightweight polymeric materials having compact dimensions. Preferably, the cover is comprised of a transparent, water impervious material.

A still further object of the present invention is to provide for a golf bag cover which is easily replaceable by the golfer when damaged.

A still another object of the present invention is to provide for a flexible golf bag cover which does not use ribs or umbrella-type support linkage to maintain the cover in operative engagement with the open end of a golf bag.

An additional object of the present invention is to provide for a flexible golf bag cover which may be stored in an elongated plastic tube adjacent similar configured or polymeric plastic tubes utilized to store individual golf clubs. However, it is also understood by those skilled in the art that the invention can also be utilized in golf bags having built-in elongated tubes for protecting the shafts of golf clubs. In such embodiments, the built-in elongated tube is utilized to house rigid support member and the flexible cover member of the present invention.

The foregoing has outlined some of the most pertinent objects of the invention. These objects should be construed to be merely illustrative of some of the more prominent features and applications of the intended invention. Many other beneficial results can be attained by applying the disclosed invention in a different manner or by modifying the invention within the scope of the disclosure. Accordingly, other objects and a more detailed understanding of the invention may be had by referring the drawings, the detailed description of the invention and the claims which follow below.

BRIEF DESCRIPTION OF THE DRAWINGS

The invention may take form in various components and arrangements of components. The drawings are only for purposes of illustrating a preferred embodiment and are not to be construed as limiting the invention.

DETAILED DESCRIPTION OF THE PREFERRED EMBODIMENTS

Figure 1:
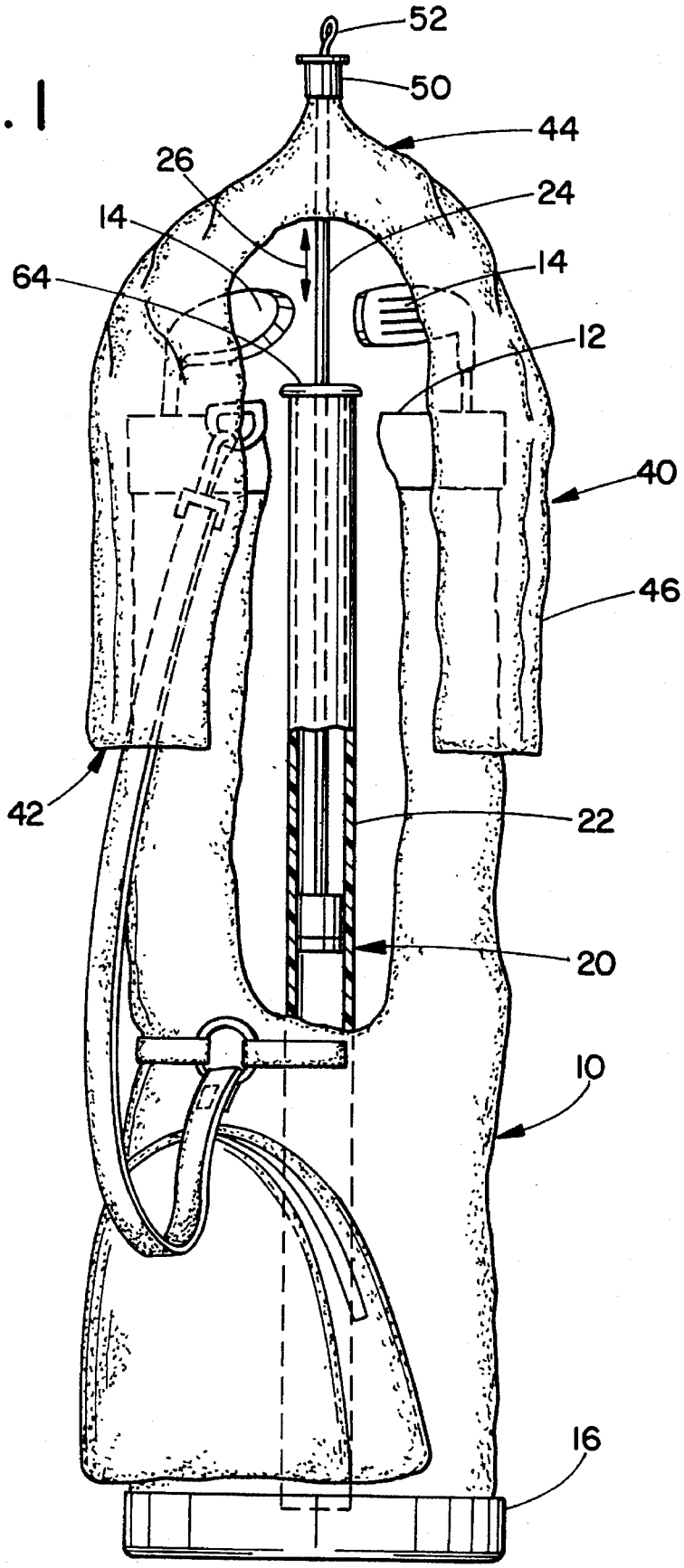
FIG. 1 illustrates the flexible cover mounted over the open end of a golf bag, which is schematically shown.

FIG. 1 schematically illustrates a conventional golf bag 10 having an open top 12 and a substantially closed bottom 16. One or more golf clubs 14 can be housed within the bag 10 and extend upwardly above the open top 12 of the bag.

Figure 2:
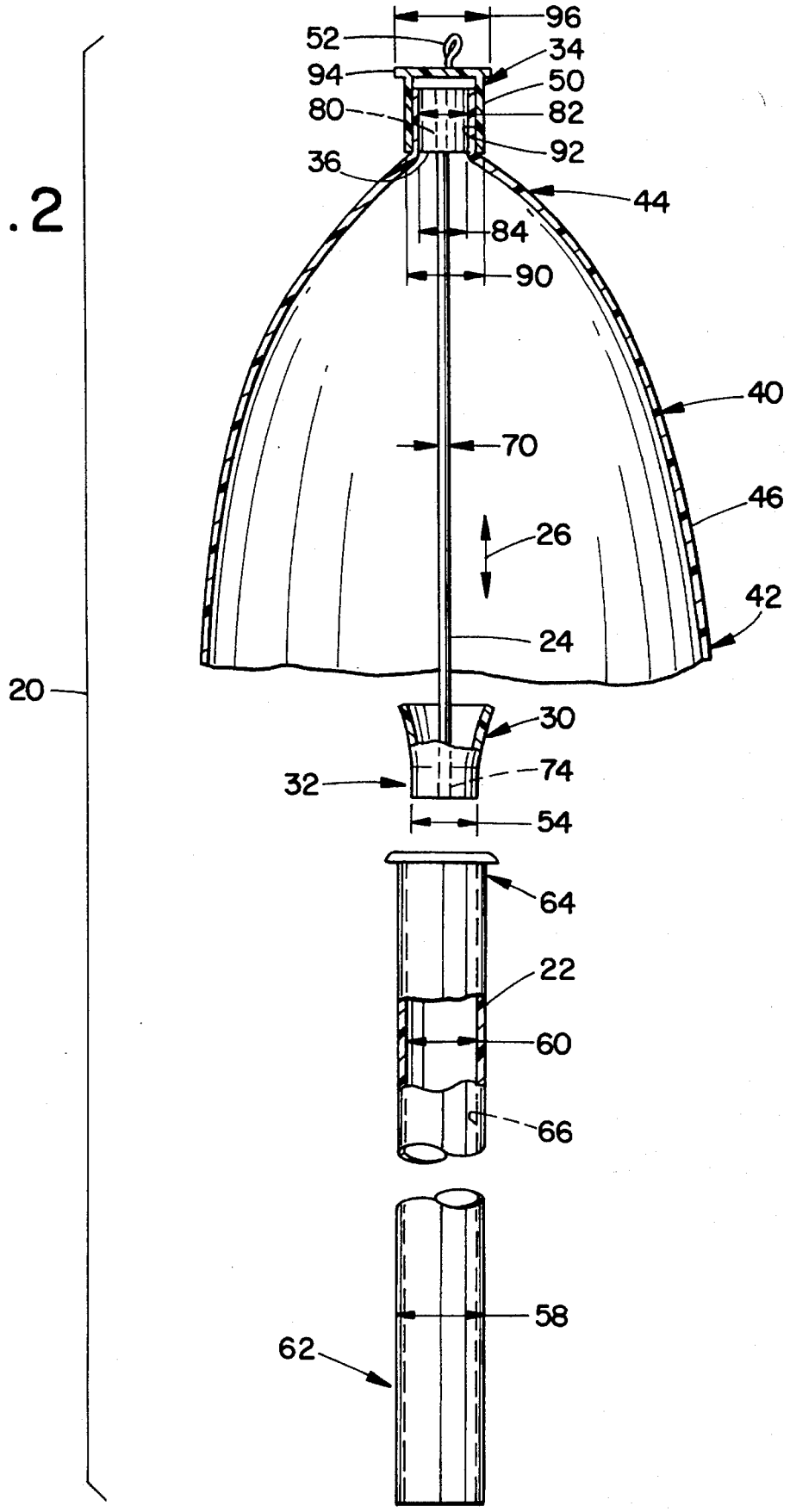
FIG. 2 is a fragmentary, schematic view showing the major parts in disassembled condition.

With further reference to FIG. 1 and with additional reference to FIG. 2, the foldable cover device 20 of the present invention generally comprises a vertically arranged, elongated open ended housing tube 22 which fits coaxially within the golf bag 10 along with one or more golf clubs 14. Although in FIG. 1, the housing tube 22 is preferably centrally located in golf bag 10, the housing tube 22 can be vertically arranged in essentially any location in the golf bag 10. Less preferably, the housing tube 22 can be positioned external to the golf bag 10. This embodiment is not shown in the figures.

Housing tube 22 has an inner diameter 60 and an outside diameter 58, an upper end 64 and a lower end 62, and is preferably cylindrical in structure. Ideally, the outer diameter should have a diameter around 1½ inches or less. However, as it is understood by those skilled in the art, alternative shaped structures such as elongated pentagons, octagons, etc. are also within the scope of the present invention.

A rigid rod 24 is adapted to be coaxially received within the housing tube 22 and is moveable along a longitudinal axis 26 thereof. The rigid rod 24 has a lower end portion 30 and an upper end portion 34. Connected to the lower end portion 30 of the rigid rod 24 is a generally cylindrical retaining guide 32 for substantially inhibiting radial movement of the rigid rod 24 within the inner diameter 60 of tube 22. In addition, the retaining guide also variably restricts axial movement of the rigid rod 24 within tube 22. Connected to the upper end portion 34 of the rigid rod is a generally cylindrical shoulder 36 formed preferably from a compressible material such as synthetic foam.

A flexible cover or sheath 40 formed from a thin, water impervious material, such as plastic or a polymeric sheathing, has an open peripheral end 42, a closed central end 44, and a loose side wall 46 connected therebetween. The loose side wall 46 may be of variety of lengths and preferably extends about half way down bag 10. The flexible cover 40 is capable of being stored coaxially between the inner diameter 60 of housing tube 22 and the rigid rod 24.

The upper end 34 of the rigid rod including the shoulder 36 is positioned within the flexible cover 40 and is in releasable contact with the closed end portion 44 thereof. The closed central end 44 is secured against the shoulder 36 by virtue of retaining cap 50 formed of a suitably resilient plastic-like material. Preferably, the closed end portion 44 of the flexible cover 40 is positioned between the shoulder 36 and retaining cap 50 by means of a frictional or compressive force. However, alternative reversible securing arrangements and materials are also contemplated.

In addition, a pull tab or gripping member 52 is attached to the retaining cap 50 and extends outwardly therefrom. This gripping member allows the rigid rod 24 and flexible cover 40 to be pulled or extracted from the tube 22 as needed.

With continuing reference to FIG. 2, the flexible cover 40 in the preferred embodiment is defined by a flexible, plastic or polymeric bag the open end 42 of which has a diameter slightly larger than a diameter of the open end 12 of the golf bag 10. As will be described below, the flexible cover 40 (such as that in the form a plastic bag) is secured to the rigid rod 24 by means of the releasable retaining cap 50. During normal use, the plastic bag cover may be subject to tears, rips and/or other damage. The present invention allows for easy replacement of the damaged plastic bag or covering 40 with a new plastic bag.

With reference to FIG. 1, the plastic bag is shown in operative use as the flexible cover 40 with an open end 12 of a golf bag 10. In use, the closed end 44 of the cover 40 is supported vertically by the rigid rod 24. The open end 42 of the cover 40 covers the open end 12 of the golf bag 10. This arrangement eliminates the need of umbrella linkage as shown in the prior issued patents discussed above.

Optionally, various means for securing the open peripheral end 42 of the flexible cover 40 to the surface of the golf bag 10 may also be incorporated into the invention. Such securing members include snaps, buttons, velcro strips and any other securing members which inhibit displace due to weather conditions such as wind, etc.

With continuing reference to FIG. 2, tube 22 includes an inner diameter 60 which extends between lower and upper open ends 62, 64 respectively. The tube inner diameter 60 is defined by a smooth inner surface 66 which facilitates sliding movement of the rod 24 and flexible cover 40 when stored therein. As shown in FIG. 1, the overall length of the tube is preferably such that the upper end 64 reaches near the golf bag opening 12.

The rigid rod 24 is shown completely withdrawn (FIG. 2) from the housing tube 22. In operative use, the rigid rod 24 is generally partially extended from the tube 22 in order to allow the flexible cover 40 to be unwrapped and/or unrolled and folded or dropped over the golf bag 10. In one embodiment, the rigid rod comprises a wooden dowel rod having an outer diameter 70 substantially less than the inner diameter 60 of the tube. Naturally, alternative materials such as fiberglass, aluminum etc. can also be utilized to form the rigid rod 24. However, the outer diameter 70 of the rigid rod 24 must be selected so that enough coaxial space exists between the outer diameter 70 and the inner diameter 60 for storing the foldable cover 40 in a rolled up or wrapped condition.

Retaining guide 32 and shoulder 36 are shown attached to the lower end portion 30 and upper end portion 34, respectively. The retaining guide 32 is arranged coaxially with the rigid rod 24 and has an outer diameter 54 slightly less (when inserted) than the inner diameter 60 of the tube. Preferably the retaining guide 32 comprises compressed polymeric foam having an outer diameter 54 slightly greater than the inner diameter 60 of the tube when uninserted and a diameter 54 slightly less than the inner diameter 60 of the tube when compressed and inserted. In this configuration, the retaining guide 32 can slide along the smooth inner surface 66 of the tube and substantially prevent the rigid rod 24 from moving radially with respect to the longitudinal axis 26.

The retaining guide 32 in one embodiment can be formed from thermoplastic or other resilient material having a bore 74 formed axially therethrough. The diameter of the bore should be slightly greater than the outer diameter of the rigid rod 70 to facilitate receipt of one end therein. The retaining guide 32 can be secured to the rigid rod 24 using conventional attachment techniques, such as gluing, pinning, etc.

Connected at the upper end portion 34 of the rigid rod, the shoulder 36 provides a support upon which the closed end 44 of the flexible bag or cover 40 is secured. In the preferred embodiment, the shoulder is formed from a compressible foam-like material having a bore 80 extending therethrough. An end of the rigid rod 24 is inserted into the bore 80 and secured therein using conventional techniques. Outer diameter 82 of the shoulder is greater than an inner diameter 84 of the retaining cap 50 when uncompressed for reasons which will be explained below.

The retaining cap 50 is preferably formed from a resilient thermoplastic material. Outer diameter 90 is less than the inner diameter 60 of the tube to facilitate receipt of the retaining cap therein. The retaining cap provides a means for releaseably securing the foldable flexible cover 40 to the rigid rod 24. As stated above, the inner diameter 84 is preferably less than the outer diameter 82 of the shoulder.

In operation, the shoulder 36 is inserted into the foldable cover 40 and positioned at the closed end portion 44 thereof. With the closed end portion 44 contacting the shoulder, the retaining cap is forced over the shoulder 36. As the retaining cap is forced over the shoulder, the compressible nature of the shoulder allows the outer diameter 82 to be reduced. Once the shoulder 36 and the closed end portion 44 of the flexible cover 40 are contained within the retaining cap 50, the spring-like nature of the synthetic foam material creates a radially outward directed force against the closed end portion 44 of the foldable cover 40 and the inner surface 92 of the retaining cap, thereby providing a gripping force which holds or secures the cap 50 over the shoulder 36 and foldable cover 40.

The retaining cap 50 contains a radially projecting lip 94 which has a diameter 96 greater than the inner diameter 60 of the tube. The lip 94 prevents the retaining cap from being completely insertable within the housing tube 22.

A gripping member or pull string 52 is fastened to the retaining cap 50 and extends outwardly therefrom. With retaining cap 50 secured to the shoulder 36 and foldable flexible cover 40, the gripping member allows a golfer to pull or extend the rigid rod 24 and flexible cover 40 from the tube 22.

As stated, the foldable cover device 20 of the present invention is designed to be readily available when needed and quickly restorable using a minimum amount of space in the golf bag 10. To open the foldable cover device 20, a golfer pulls the gripping member 52 until the foldable flexible cover 40 is withdrawn from the tube 22. Thereafter, a golfer unfolds or unwraps the foldable flexible cover 40 so that the open end thereof may be positioned over the open end 12 of the golf bag 10.

In use, the device 20 of the present invention provides protection of the golf clubs 14 against descending precipitation. When not in use, the foldable cover 40 can be stored within the housing tube 22 between the outer diameter of the rigid rod 24 and the inner diameter 60 of the tube 22.

Figure 3:
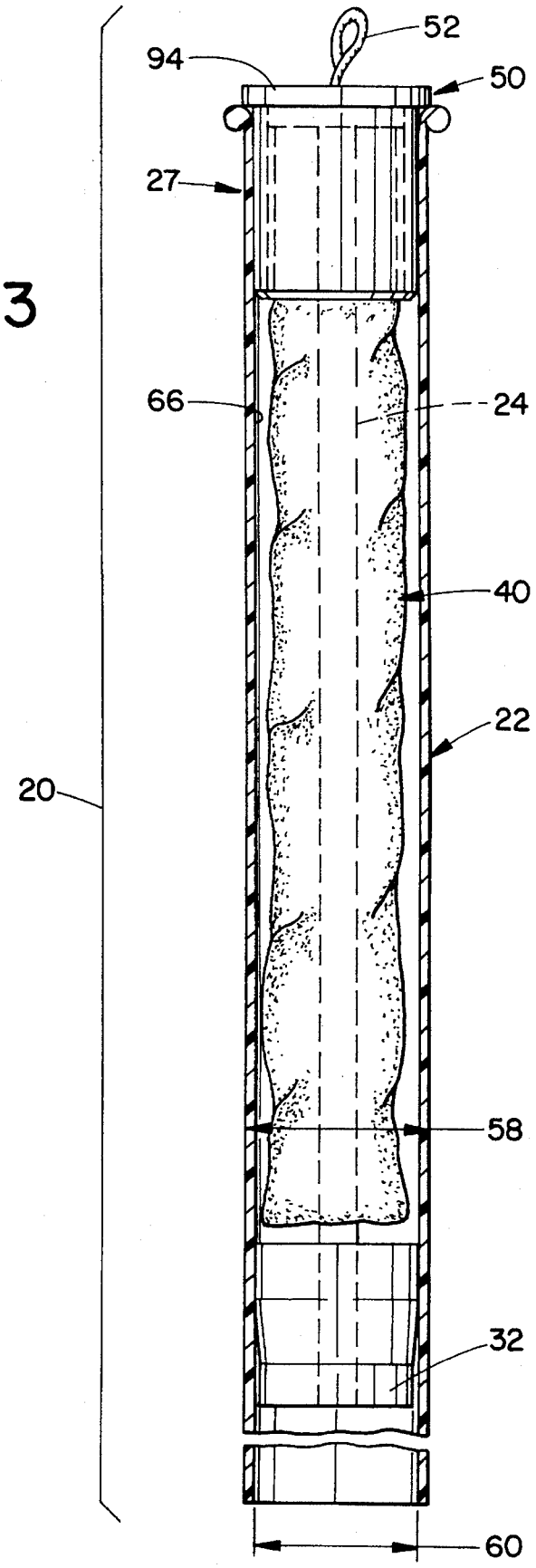
FIG. 3 is a view of the housing tube with the wrapable cover contained therein.

FIG. 3 shows the housing tube 22 extending between upper and lower open ends 27, 28 with the flexible cover 40 contained therein and illustrates the compactness provided by the present invention. For storage, the golfer twists the retaining cap 50 in one direction while sliding the other hand downwardly along the rigid rod 24 and foldable cover 40. In this fashion, the foldable cover 40 can be wrapped tightly around the rigid rod 24. With the foldable flexible cover 40 wrapped around the rigid rod 24, the combination of rod 24 and foldable cover 40 is pushed downwardly into the housing tube 22 using a twisting motion. Finally, the rigid rod 24 and cover 40 are moved along the longitudinal axis of the tube until the retaining cap 50 lip engages the rim of the upper open end 27 of the tube 22.

Alternatively, in a further embodiment, the foldable cover device 40 of the present invention can be utilized with golf club bags having built-in tubes (not shown) for storing the shafts of the golf clubs. In such an embodiment, one of the built-in tubes is utilized as the housing tube 22 for storing the rigid rod/flexible cover arrangement of the invention.

The invention has been described with reference to the preferred embodiment. Obviously, modifications and alterations will occur to others upon reading and understanding the preceding detailed description. It is intended that the invention be construed as including all such modifications and alterations as far as they come within the scope and spirit of the appended claims or the equivalents thereof.

Having thus described the preferred embodiments, the invention is now claimed to be:

1. An engageable device for protecting an open upper end of a golf bag from descending precipitation, comprising:

a vertically arranged, elongated tubular housing member adapted to fit within the golf bag along with one or more golf clubs, said tubular housing member having a smooth inner cylindrical surface extending along a longitudinal axis and an opened upper end portion and a lower end portion;

an elongated rigid support member contained in and aligned coaxially with the elongated tubular housing member and movable along the longitudinal axis, said elongated rigid support member having a diameter substantially less than an inner diameter of the tubular housing member, and upper end portion and lower end portion; and a flexible, ribless, water impervious member for substantially covering the open end of the golf bag, said flexible, ribless, water impervious member having a central closed end portion positioned between a retaining cap and shoulder supported by the upper end portion of the elongated rigid support member and a peripheral open end portion extending from the closed end, wherein during non-use the flexible, ribless, water impervious member is positioned in a foldable condition in the tubular housing member between the inner surface of the tubular housing member and the rigid support member and wherein during use the flexible, ribless water impervious member is positioned exterior the tubular housing member in an unfolded condition.

2. The device of claim 1 wherein the flexible, ribless, water impervious member is formed from a thin, polymeric sheet-like material.

3. The device of claim 2 wherein the flexible, ribless, water impervious member is adapted to be folded around the rigid support member using a twisting motion, and inserted into the elongated tubular housing member.

4. The device of claim 2, wherein the lower end portion of the rigid support member includes a cylindrical retaining guide member having an outer diameter slightly less than the inner diameter of the tubular housing member, the cylindrical retaining guide member being secured coaxially with the rigid support member and having a smooth outer surface which slidably engages the smooth inner cylindrical surface of the elongated tubular housing member thereby inhibiting radial movement of the rigid support member.

5. An engageable foldable covering device for protecting an open, upper end of a golf bag, comprising:

an elongated, tubular housing member formed from a rigid, polymeric material, said tubular housing member being adapted to fit within the golf bag along with one or more golf clubs and having a smooth inner cylindrical surface extending along a longitudinal axis, an opened upper end portion and a lower end portion;

an elongated, rigid support member contained in, aligned with, and movable along the longitudinal axis of said tubular housing mender, said rigid support member having a diameter substantially less than an inner diameter of said tubular housing member, an upper end portion and a lower end portion;

a generally cylindrical shoulder formed of a synthetic foam-like material having an elastic memory which allows the shoulder to return to its original shape after being compressed, said shoulder engaging the upper end portion of the rigid support member and extending radially outward therefrom, said shoulder having an outer diameter less than the inner diameter of said tubular housing member; and a flexible polymeric sheath for substantially enclosing the open upper end of the golf bag, said flexible polymeric sheath having a central closed end portion secured by a retaining cap to said shoulder, a peripheral open end portion adapted to receive the open upper end of a golf bag and a free standing side wall extended therebetween, wherein during non-use the flexible, polymeric sheath is positioned between the inner surface of the tubular housing member and the rigid support member and wherein during use the flexible, polymeric sheath is positioned exterior the tubular housing member in an unfolded condition.

6. The engageable foldable covering device of claim 5 wherein said sheath is adapted to be folded around said rigid support member using a twisting motion, the combination of said rigid support member and flexible polymeric sheath being adapted to be received within said tubular housing member.

7. The foldable covering device of claim 5 wherein the retaining cap is generally cylindrical and arranged coaxially around said shoulder and said flexible polymeric sheath for releasably securing said flexible, polymeric sheath to said shoulder, said retaining cap having an outer diameter slightly less than the inner diameter of said tubular housing member and a lip positioned circumferentially on an outer surface of said retaining cap and extending radially outward, said lip having an outer diameter greater that the inner diameter of said tubular housing member.

8. The foldable covering device of claim 5 further comprising a gripping member supporting said retaining cap and extending coaxially outward therefrom, for removing said flexible, polymeric sheath from said tubular housing member.

9. The foldable covering device of claim 5 further comprising a generally cylindrical retaining guide supporting the lower end portion of said rigid support member and arranged coaxially thereto, said retaining guide having an outer diameter slightly less than the inner diameter of said tubular housing member wherein, wherein when said rigid support member is being positioned through said tubular housing member, said retaining guide prohibits substantial radial movement of said rigid support member with respect to the longitudinal axis.

10. The foldable covering device of claim 5 wherein the rigid support member is slightly less in length than the length of the tubular housing member.

11. An engageable foldable covering device for protecting an open upper end of a golf bag from descending precipitation, comprising:

a vertically arranged, elongated, polymeric tubular housing member adapted to fit within the golf bag along with one or more golf clubs and having a smooth inner surface extending longitudinally between first and second open ends;

an elongated, rigid support member coaxially aligned and movable within said tubular housing member, said rigid support member having an outer diameter smaller than an inner diameter of said tubular housing member, an upper end portion and a lower end portion;

a flexible, polymeric, water impervious covering member for covering the open upper end of the golf bag, said flexible, covering member having a central closed end portion which is supported by the upper end portion of said rigid support member, a peripheral open end portion adapted to receive the open upper end of the golf bag and a free standing side wall connected therebetween, wherein during non-use the flexible, polymeric covering member is positioned between the inner surface of the tubular housing member and the rigid support member, and wherein during use the flexible, polymeric covering member is positioned exterior the tubular housing member in an unfolded condition;

a means for securing the end portion of said flexible polymeric covering member to the upper portion of said rigid support member, said means for securing further including a generally cylindrical shoulder formed of a compressible material attached to the upper end portion of said rigid support member and extending coaxially therewith, said flexible polymeric covering member having a closed end portion being in contact with an outer surface of said shoulder, and a retainer cap formed of a resilient polymeric material having a cylindrical wall with an outer diameter less than an inner diameter of said tubular housing and an inner diameter defining a bore into which is received said shoulder and flexible polymeric covering member end portion, said inside diameter being less than an outer diameter of said shoulder when said shoulder is in an uncompressed state.

12. The foldable covering device of claim 11 wherein said flexible, polymeric covering member is adapted to be inserted in said tubular housing using a twisting motion.

13. The foldable covering device of claim 11 wherein the tubular housing member has an outer diameter less than about 1½ inches.

14. The foldable covering device of claim 11 wherein the tubular housing member is positioned within the golf covering member alongside one or more other or more similarly configured tubular housing members for receiving golf clubs.

* * * * *